US012674381B2

(12) United States Patent
Xu et al.

(10) Patent No.: US 12,674,381 B2
(45) Date of Patent: Jul. 7, 2026

(54) TECHNOLOGIES FOR CONTROLLING MUD MOTOR TRAJECTORY

(71) Applicant: Halliburton Energy Services, Inc., Houston, TX (US)

(72) Inventors: Shichao Xu, Singapore (SG); Nazli Demirer, Houston, TX (US); Vy Pho, Houston, TX (US); Yang Liu, Singapore (SG); Ketan C. Bhaidasna, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 135 days.

(21) Appl. No.: 18/502,920

(22) Filed: Nov. 6, 2023

(65) Prior Publication Data

US 2025/0146400 A1 May 8, 2025

(51) Int. Cl.
*E21B 44/00* (2006.01)
*E21B 7/04* (2006.01)
*E21B 47/024* (2006.01)

(52) U.S. Cl.
CPC ..... *E21B 44/00* (2013.01); *E21B 7/04* (2013.01); *E21B 47/024* (2013.01)

(58) Field of Classification Search
CPC ..... E21B 44/00; E21B 7/04; E21B 47/024
See application file for complete search history.

(56) References Cited

U.S. PATENT DOCUMENTS

| | | | | |
|---|---|---|---|---|
| 10,358,904 | B2 * | 7/2019 | Kyllingstad | E21B 7/10 |
| 10,612,307 | B2 * | 4/2020 | Summers | E21B 7/10 |
| 11,585,205 | B2 * | 2/2023 | Neufeldt | E21B 44/04 |
| 2012/0018218 | A1 * | 1/2012 | Rosenhauch | E21B 4/02 175/45 |
| 2019/0292898 | A1 | 9/2019 | Quattrone | |
| 2020/0095860 | A1 * | 3/2020 | Zalluhoglu | E21B 47/022 |
| 2021/0388677 | A1 | 12/2021 | Summers | |
| 2022/0372861 | A1 | 11/2022 | Wu et al. | |
| 2023/0046043 | A1 | 2/2023 | Hansen | |
| 2023/0096963 | A1 | 3/2023 | Demirer | |

OTHER PUBLICATIONS

International Search Report and Written Opinion mailed Jul. 26, 2024 in PCT/US2023/037276.

* cited by examiner

*Primary Examiner* — Yong-Suk (Philip) Ro
(74) *Attorney, Agent, or Firm* — The Hilton Firm PLLC

(57) ABSTRACT

Techniques for controlling a trajectory of a mud motor directional drill. A system receives one or more inputs pertaining to constraints for a wellbore in a mud motor drilling operation. The system constructs, as a function of the one or more inputs, a discretized well depth horizon. One or more binary slide and rotate commands for controlling a directional drill within the wellbore is generated based on an analysis of the discretized well depth horizon. The system controls the directional drill according to the one or more binary slide and rotate commands.

7 Claims, 7 Drawing Sheets

TECHNOLOGIES FOR CONTROLLING MUD MOTOR TRAJECTORY

TECHNICAL FIELD

The present disclosure generally relates to directional drilling tools, and more generally, to technologies for generating trajectory controls for a mud motor directional drilling tool.

BACKGROUND

In the oil and gas environment, directional drilling pertains to boring a well at multiple angles (both vertically and horizontally) to reach and produce oil and gas reserves from a planned well path. Doing so allows the oil and gas to be extracted more efficiently while also lessening environmental impact. One example of a directional drilling tool is a mud motor directional drill, which converts mud flow (e.g., hydraulic energy) into bit rotations (e.g., mechanical energy). A typical mud motor drill has two operation modes: slide mode and rotate mode. During a slide mode, the bit rotates (without any drill string rotation) and steers the borehole to a desired direction. In a rotate mode, the entire drill string rotates at a planned angle. Generally, the drilling process involves a series of slide and rotate sequences following a planned trajectory performed under dynamic system and environmental constraints.

BRIEF DESCRIPTION OF THE DRAWINGS

Illustrative embodiments of the present disclosure are described in detail below with reference to the attached drawing figures, which are incorporated by reference herein, and wherein.

Figure 1:
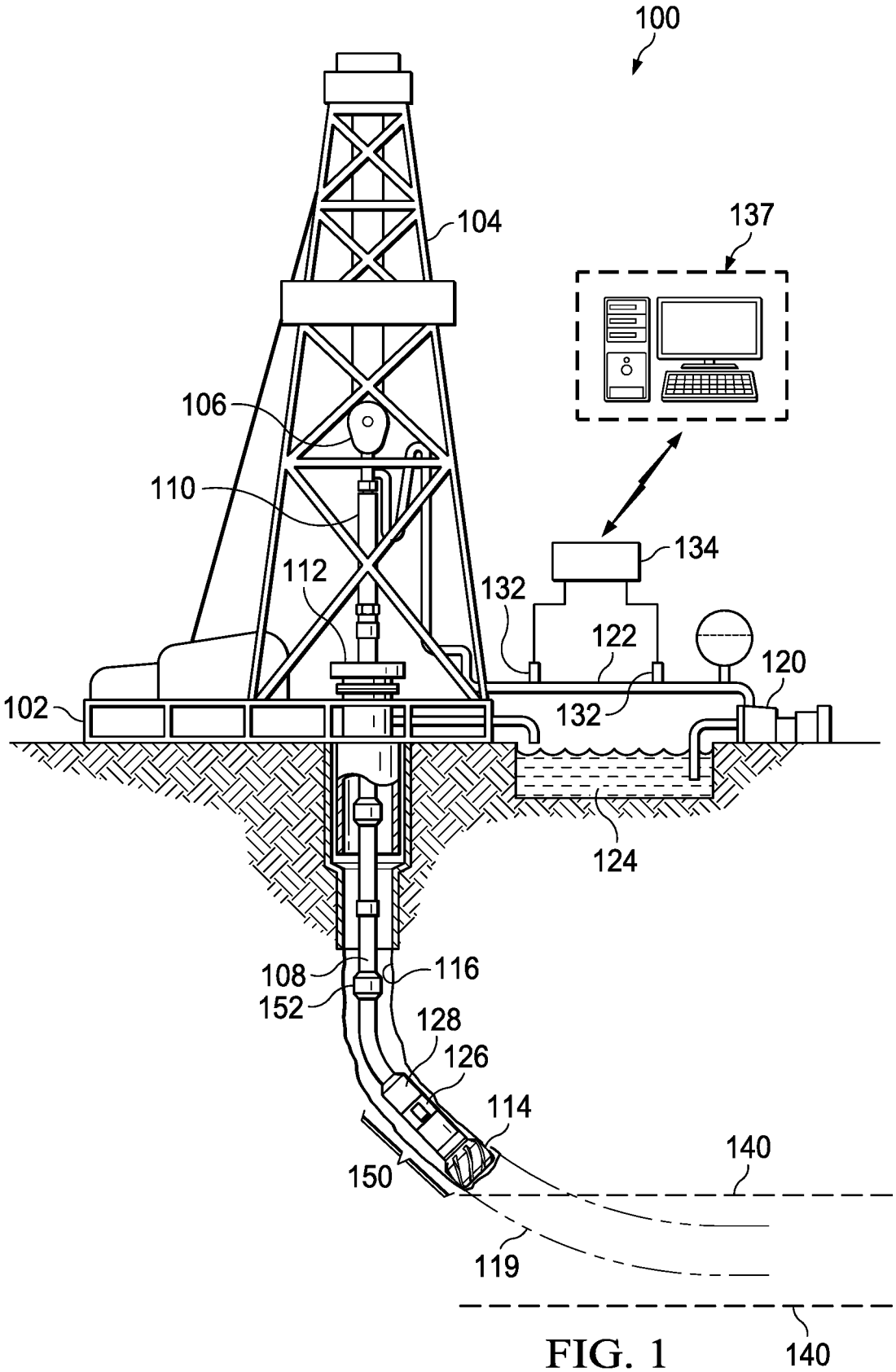
FIG. 1 illustrates an example directional drilling environment in which mud motor directional trajectory control techniques of the present disclosure may be deployed, according to an embodiment.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

A mud motor directional drill typically has two operation modes: a slide mode and a rotate mode. During operation, the directional drill performs a series of slide and rotate sequences, typically according to a planned trajectory and system and environmental constraints. Such constraints may include minimum slide and rotate lengths and whether to start the drill in slide mode or rotate mode. Generally, the system and environmental constraints are not static and are thus subject to change in practice. For example, variations in formation, changes in drilling conditions, and additional safety concerns may affect the planned trajectory. For instance, when drilling in a curve section, a long slide length may be preferred to achieve required inclinations to build the curve. Conversely, a shorter slide length may be preferred to avoid risking stuck pipes in the well bore, which may then lead to frequent switching between slide and rotate modes. Prior approaches to directional drilling lack means to systematically address such constraints given a preferred type of control strategy.

To address such concerns, embodiments of the present disclosure provide techniques for generating trajectory controls for a mud motor directional drill. More particularly, the present disclosure provides a model predictive control strategy that integrates mixed integer-based optimization, which can be implemented in a single module within a system having one or more processors and a memory. The system tracks the well plan attitude and position over a given look-ahead distance (e.g., over the next hundreds of feet) and generates a binary slide-rotate command sequence. The system may obtain specifications of different control objectives to prioritize different control schemes, such as attitude control, position control, and hybrid control (e.g., a scheme that combines attitude and position control). In an embodiment, linear dynamic models that describe the behavior between toolface angles and slide-rotate modes (represented as binary variables) for both inclination and azimuth planes may also be incorporated to estimate a wellbore trajectory for tracking well plan attitude and position under the control objectives.

Advantageously, the techniques of the present disclosure generates a command sequence that ensures accurate tracking of a desired well trajectory (based on inclination and azimuth measurements) and curvature demands. Further, the techniques described herein allow for selected control objectives to be achieved while satisfying various system constraints.

Referring now to FIG. 1, a directional drilling environment, particularly showing a drilling system 100, in which the presently disclosed techniques may be deployed. As depicted, the drilling system 100 includes a drilling platform 102 having a derrick 104 and a hoist 106 to raise and lower a drill string 108. Hoist 106 suspends a top drive 110 suitable for rotating drill string 108 and lowering drill string 108 through a well head 112. Notably, drill string 108 may include sensors or other instrumentation for detecting and logging nearby characteristics and conditions of the wellbore and surrounding earth formation. In an embodiment, the drilling system 100 may be representative of a measurement-while-drilling (MWD) system.

In operation, top drive 110 supports and rotates drill string 108 as it is lowered through well head 112. In this manner, drill string 108 (and/or a downhole motor) rotates a drill bit 114 to create a borehole 116 through various formations. A pump 120 can circulate drilling fluid through a supply pipe 122 to top drive 110, down through an interior of drill string 108, through orifices in drill bit 114, back to the surface via an annulus around drill string 108, and into a retention pit 124. The drilling fluid can transport cuttings from wellbore 116 into pit 124 and helps maintain wellbore integrity. Various materials can be used for drilling fluid, including oil-based fluids and water-based fluids.

As shown, the drill bit 114 forms part of a bottom hole assembly 150, which further includes drill collars (e.g., thick-walled steel pipe) that provide weight and rigidity to aid drilling processes. Detection tools 126 and a telemetry sub 128 are coupled to or integrated with one or more drilling collars.

Detection tools 126 may gather drill survey data or other data and may include various types of electronic sensors, transmitters, receivers, hardware, software, and/or additional interface circuitry for generating, transmitting, and detecting signals (e.g., sonic waves, etc.), storing information (e.g., log data), communicating with additional equipment (e.g., surface equipment, processors, memory, clocks input/output circuitry, etc.), and the like. In particular, detection tools 126 can measure data such as position, orientation, weight-on-bit, strains, movements, borehole diameter, resistivity, drilling tool orientation, which may be specified in terms of a tool face angle (rotational orientation), and inclination angle, and compass direction, each of which can be derived from measurements by sensors (e.g., magnetometers, inclinometers, and/or accelerometers, though other sensor types such as gyroscopes, etc.).

Telemetry sub 128 communicates with detection tools 126 and transmits telemetry data to surface equipment (e.g., via mud pulse telemetry). For example, telemetry sub 128 can include a transmitter to modulate resistance of drilling fluid flow thereby generating pressure pulses that propagate along the fluid stream at the speed of sound to the surface. One or more pressure transducers 132 operatively convert the pressure pulses into electrical signal(s) for a signal digitizer 134. It is appreciated other forms of telemetry such as acoustic, electromagnetic, telemetry via wired drill pipe, and the like may also be used to communicate signals between downhole drilling tools and signal digitizer 134. Further, it is appreciated telemetry sub 128 can store detected and logged data for later retrieval at the surface when bottom hole assembly 150 is recovered.

Digitizer 134 converts the pressure pulses into a digital signal and sends the digital signal over a communication link to a computing system 137 or some other form of a data processing device. In at least some embodiments, computer system 137 includes processing units to analyze collected data and/or perform other operations by executing software or instructions obtained from a local or remote non-transitory computer-readable medium. As shown, computer system 137 includes input device(s) (e.g., a keyboard, mouse, touchpad, etc.) as well as output device(s) (e.g., monitors, printers, etc.). These input/output devices provide a user interface that enables an operator to interact and communicate with the bottom hole assembly 150, surface/downhole directional drilling components, and/or software executed by computer system 137.

For example, computer system 137 enables an operator to select or program directional drilling options, review or adjust types of data collected, modify values derived from the collected data (e.g., measured bit position, estimated bit position, bit force, bit force disturbance, rock mechanics, etc.), adjust borehole assembly dynamics model parameters, generate drilling status charts, waypoints, a desired borehole path, an estimated borehole path, and/or to perform other tasks. In at least some embodiments, the directional drilling performed by bottom home assembly 150 is based on a surface and/or downhole feedback loops, as discussed in greater detail below.

The drilling system 100 also includes a controller 152 that instructs or steers bottom hole assembly 150 as drill bit 114 extends wellbore 116 along a desired path 119 (e.g., within one or more boundaries 140). Controller 152 includes processors, sensors, and other hardware/software such as a rotary steerable system (RSS). In operation, the controller 152 applies a force to flex or bend a drilling shaft coupled to the bottom home assembly 150 thereby imparting an angular deviation to a current the direction traversed by drill bit 114. The controller 152 can communicate real-time data with one or more components of bottom hole assembly 150 and/or surface equipment. In this manner, the controller 152 can analyze real-time data and generate steering signals according to, for example, the feedback control techniques discussed herein. While the controller 152 is shown and described as a single component that operates for a particular type of directional drilling, it is appreciated the controller 152 may include any number of sub-components that collectively communicate and operate to perform the above discussed functions. The controller 152 represents an example component, which may further include various other types of steering mechanisms as well—e.g., steering vanes, a bent sub, and the like. It is further appreciated by those skilled in the art, the environment shown in FIG. 1 is merely provided as a reference example and not for purposes of limitation. The detection tools, drilling devices, and sliding mode control techniques discussed herein may be suitable in any number of drilling environments.

It is further appreciated by those skilled in the art, the environment shown in FIG. 1 is provided for purposes of discussion only, not for purposes of limitation. The detection tools, drilling devices, and curvature-based feedback control techniques discussed herein may be suitable in any number of drilling environments.

Figure 2:
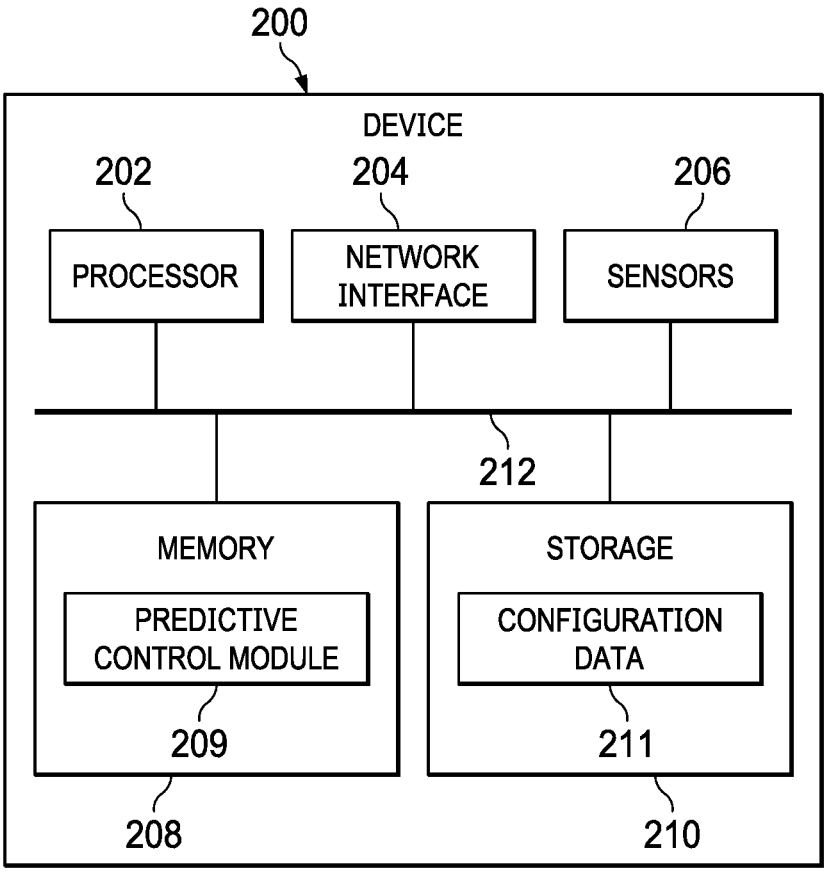
FIG. 2 illustrates an example device for performing mud motor directional trajectory control, according to an embodiment.

Referring now to FIG. 2, a block diagram of an example device 200 is shown. In an embodiment, the device 200 may represent the controller 152 (or components of the controller 152). The device 200 is configured to perform control techniques discussed herein and communicate signals that steer or direct the drilling tool along a well path trajectory. In operation, the device 200 communicates with one or more of the above-discussed bottom hole assembly 150 components and may also be configured to communicate with remote devices and systems, such as the computer system 137.

Illustratively, the device 200 includes a processor 202, network interface 204, sensors 206, memory 208, and a storage 210, each interconnected via a hardware bus 212. Of course an actual device 200 will include a variety of additional hardware components not shown. Additionally, in some embodiments, one or more of the illustrative components may be incorporated in, or otherwise form a portion of, another component.

The processor 202 retrieves and executes programming instructions stored in the memory 208. The processor 202 may be embodied as one or more processors, each processor being a type capable of performing the functions described herein. For example, the processor 202 may be embodied as a single or multi-core processor(s), a microcontroller, or other processor or processing/controlling circuit. In some embodiments, the processor 202 may be embodied as, include, or be coupled to a field programmable gate array (FPGA), an application-specific integrated circuit (ASIC), reconfigurable hardware or hardware circuitry, or other specialized hardware to facilitate performance of the functions described herein. The hardware bus 212 is used to transmit instructions and data between the processor 202, storage 210, network interface 204, and the memory 208. The processor 202 is included to be representative of a single CPU, multiple CPUs, a single CPU having multiple processing cores, and the like. The memory 208 may be embodied as any type of volatile (e.g., dynamic random access memory, etc.) or non-volatile memory (e.g., byte addressable memory) or data storage capable of performing the functions described herein. Volatile memory may be a storage medium that requires power to maintain the state of data stored by the medium. Non-limiting examples of volatile memory may include various types of random access memory (RAM), such as DRAM or static random access memory (SRAM). One particular type of DRAM that may be used in a memory module is synchronous dynamic random access memory (SDRAM). In particular embodiments, DRAM of a memory component may comply with a standard promulgated by JEDEC, such as JESD79F for DDR SDRAM, JESD79-2F for DDR2 SDRAM, JESD79-3F for DDR3 SDRAM, JESD79-4A for DDR4 SDRAM, JESD209 for Low Power DDR (LPDDR), JESD209-2 for LPDDR2, JESD209-3 for LPDDR3, and JESD209-4 for LPDDR4. Such standards (and similar standards) may be referred to as DDR-based standards and communication interfaces of the storage devices that implement such standards may be referred to as DDR-based interfaces.

The network interface 204 may be embodied as any hardware, software, or circuitry (e.g., a network interface card) used to connect the device 200 over a network and providing network communication component functions. For example, the network interface 204 may be embodied as any communication circuit, device, or collection thereof, capable of enabling communications over the network between the device 200 and other devices (e.g., components of the bottom hole assembly 150, computer system 137, etc.). The network interface 204 may be configured to use any one or more communication technology (e.g., wired, wireless, and/or cellular communications) and associated protocols (e.g., Ethernet, Bluetooth®, Wi-Fi®, WiMAX, 5G-based protocols, etc.) to effect such communication. For example, to do so, the network interface 204 may include a network interface controller (NIC, not shown), embodied as one or more add-in-boards, daughtercards, controller chips, chipsets, or other devices that may be used for network communications with remote devices. For example, the NIC may be embodied as an expansion card coupled to an I/O device interface over an expansion bus such as PCI Express.

The sensors 206 may be embodied as any hardware, software, and or circuitry to obtain measurements associated with the wellbore, such as magnetic fields, seismic activity, acoustic waves, and the like. The sensors 206 may include special-purpose processors, detectors, transmitters, receivers, and the like to generate, transmit, receive, detect, log, and/or sample wellbore measurements.

As shown, the memory 208 may include a predictive control module 209, which may be embodied as software and/or firmware for controlling a drill trajectory according to the techniques further described herein. Note, other aspects of the predictive control module 209 may be embodied as hardware, software, firmware, and/or circuitry separate from the memory 208. The storage 210 may be embodied as any type of devices configured for short-term or long-term storage of data such as, for example, memory devices and circuits, memory cards, hard disk drives (HDDs), solid-state drives (SSDs), or other data storage devices. The storage 210 may include a system partition that stores data and firmware code for the storage 210. The storage 210 may also include an operating system partition that stores data files and executables for an operating system. For instance, the illustrative storage 210 includes configuration data 211, which may be embodied as any data used in configuring the operation of the predictive control module 209, such as types of constraints data for use in determining a control trajectory, tunable parameters (e.g., such as distance increments, discretized depth lengths, starting and ending positions, etc.).

Figure 3:
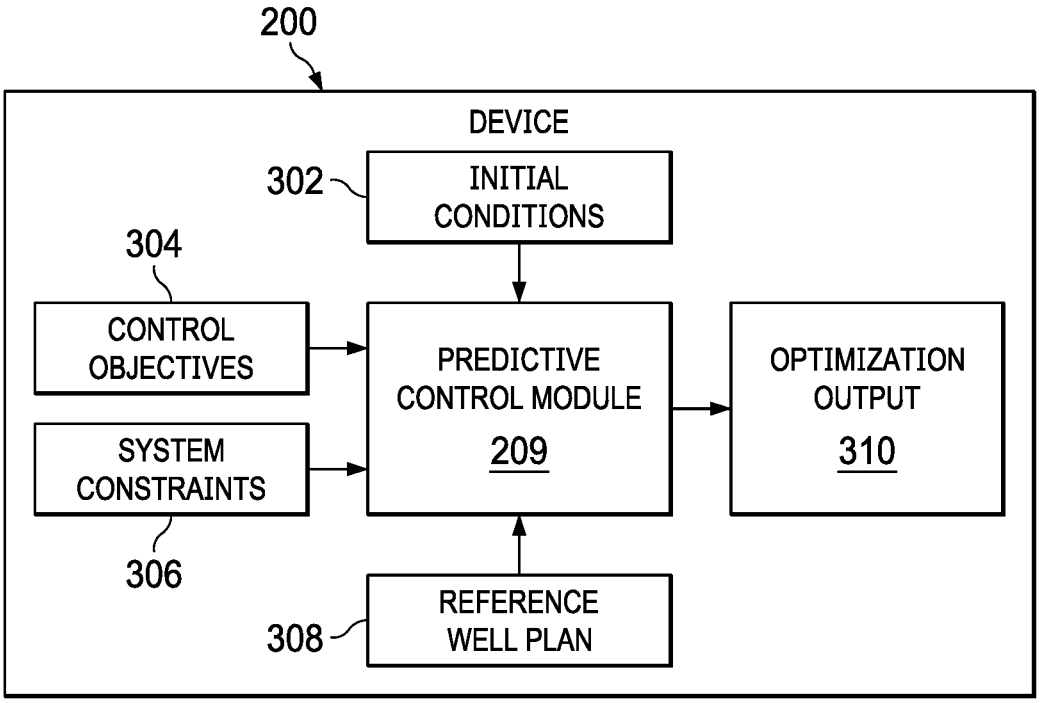
FIG. 3 illustrates an operational environment for performing mud motor directional trajectory control in the device of FIG. 2, according to an embodiment.

Referring now to FIG. 3, a conceptual diagram of an operational environment for the device 200, and more particularly, for the predictive control module 209, is shown. In an embodiment, the predictive control module 209 provides a framework that incorporates a mixed integer-based analysis to determine an efficient and accurate sequence of binary slide-rotate and toolface angle commands for the mud motor directional drill.

In an embodiment, the predictive control module 209 may receive a variety of inputs (e.g., from a console connected with the device 200, from the computer system 137, etc.), including one or more initial conditions 302, control objectives 304, system constraints 306, and a reference well plan 308. The initial conditions 302 may include a current position of the drill bit 114 and current information associated with tool steering capabilities of the assembly 150, such as values for curvature generation during slide and rotate operations. The control objectives 304 may include a specification of one or more types of control schemes to undertake during the drilling operation, such as attitude control, position control, or a hybrid of attitude and position controls. In addition, the control objectives 304 may also include a specification to ensure that the drilling system stays within a true vertical depth (TVD) and north-south/east-west (NS/EW) window using minimum number of slides. The system constraints 306 may include a specification of one or more constraints to be applied during the drilling operation, such as a minimum slide and rotate length, whether to start a stand in slide mode or rotate mode, and whether to end the stand in slide mode or rotate mode. The reference well plan 308 may be a predetermined attitude and positional plan for the directional drilling operation that the predictive control module 209 may use for tracking and reference. In an embodiment, in addition to or in the alternative, the predictive control module 209 may also receive, as an input, a target specification for tracking. Such target specifications may be given in terms of three-dimensional position coordinates, attitude, curvature, and so on.

The predictive control module 209 may generate, from the aforementioned inputs, optimization output 310. The optimization output 310 may comprise a binary slide and rotate sequence. In an embodiment, the sequence is an optimal sequence of slide commands and rotate commands to control the directional drill in an accurate and efficient manner given the inputs received by the predictive control module 209. More particularly, the slide and rotate sequence optimizes the behavior of the drill bit 114 across an entire prediction horizon given the constraints while tracking the behavior against the reference well plan 308.

Figure 4:
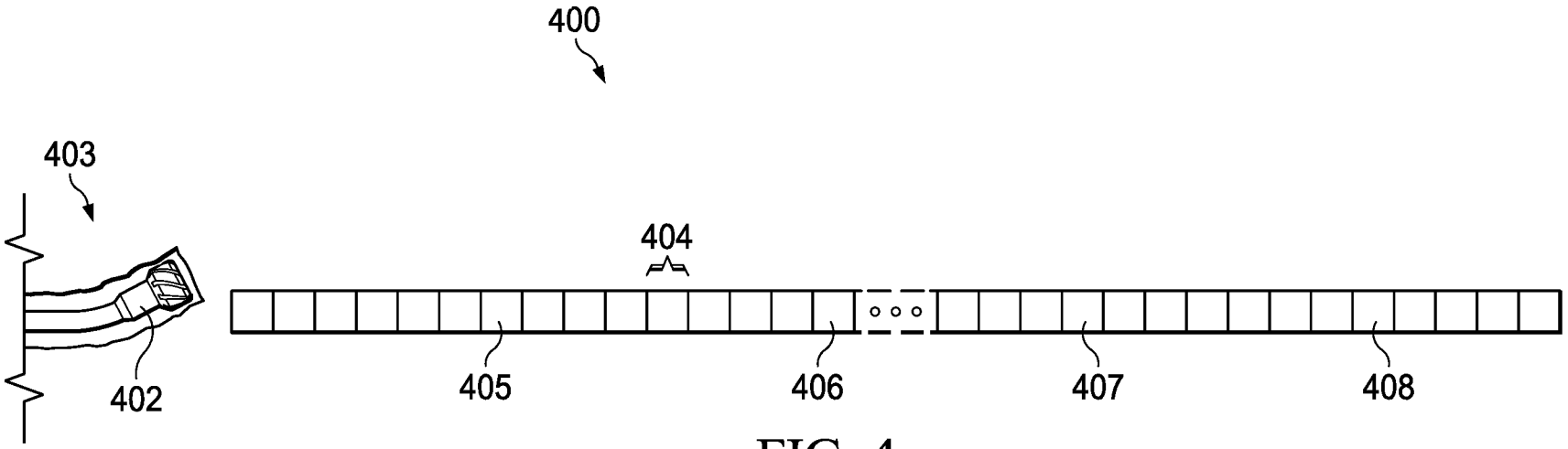
FIG. 4 illustrates a conceptual diagram of an example well depth horizon discretization, according to an embodiment.

In an embodiment, the predictive control module 209 may generate a discretized well depth horizon for use in determining an optimal control trajectory for the drill bit. The discretized well depth horizon starts from the position of the drill bit 114 and propagates over an increment (e.g., over the next hundreds of feet). Referring now to FIG. 4, a conceptual diagram of an example discretized well depth horizon 400 showing a position 402 of the drill bit 114 in borehole 403 is shown. In the example discretized well depth horizon 400, each discretized depth length 404 represents a control step, in which control actions remain the same. In practice, the length 404 may be an increment that is small enough (e.g., between one foot to five feet) such that system constraints, such as slide-rotate distance lengths can be precisely represented. Further, using a small control step length allows output to be represented directly as a binary slide rotate sequence instead of a series of slide-rotate ratios, which may then require further processing to modulate the ratios to a binary sequence. Within the discretized horizon, the location of each stand is identified to allow "tie-to-stand" process constraints to be incorporated by the precision control module 209. In an embodiment, tie-to-stand pertains to enforcing a specified slide and rotate command sequence at the start and/or end of a stand. A tie-to-stand process may include a stand (e.g., a unit) having a length around ninety fect, which can be considered a unit. At the start of a stand, a new command sequence can be issued. During the tie-to-stand process, the slide-rotate sequence may be adjusted to align with the stand. The example horizon 400 depicts a first stand location 405, ith stand location 406, i+1 stand location 407, and nth stand location 408.

To determine how the trajectory propagates through the discretized horizon, the predictive control module 209 may determine an estimated inclination and azimuth using equation (1), which is a linear function of slide and rotate tool yields and steering inputs:

$$\theta(k+1) = \theta(k) + \underbrace{\Delta k}_{\text{Discretized Depth Length}} \cdot \overbrace{[K_{slide} \cdot u(k) + K_{rotate} \cdot (1 - \delta(k))]}^{\kappa}, \tag{1}$$

in which k is an index representing a depth point in the horizon, Δk refers to the discretized depth length and θ can refer to the inclination or azimuth, K can refer to the build rate or turn rate and $K_{slide}$ and $K_{rotate}$ refers to the sliding and rotate tool yields, respectively. δ is binary, e.g., 0-refers to rotate mode and 1-refers to the slide mode and δ(k) can refer to the duty cycle at index k of the horizon. u(k) refers to as a steering input for inclination and azimuth dynamics at index k. u(k) is calculated by multiplying z(k) with the duty cycle δ(k) at index k of the horizon, where z(k) is given by cos Γ(k) in inclination plane and is therefore defined as a build command, and sin Γ(k) in azimuth plane and defined as a turn command. Γ(k) is the toolface angle at index k of the horizon. Note that u(k) equals to zero when δ(k) equals to zero (rotate mode).

In an embodiment, the predictive control module 209 may be adapted to handle a dynamically changing $K_{slide}$ and $K_{rotate}$. Further, an alternative representation of $K_{slide}$ and $K_{rotate}$ can be a function of TVD, weight-on-bit (WOB), inclination, flow rate (FR), RPM, and the like, e.g., as $K_{slide}$, $K_{rotate}$=f(TVD, WOB, Inc, FR, RPM).

In an embodiment, equation (1) may be expressed as a nonlinear dynamic model, such as:

$$\theta(k+1) = f(\theta(k), K_{slide}, K_{rotate}, u(k), \delta(k)). \tag{1a}$$

Based on the representation of the dynamic model for inclination and azimuth, equation (1) is nonlinear due to the bilinear terms given in u(k) by z(k)·δ(k). To allow the algorithm to be solved efficiently, the predictive control module 209 performs a transformation shown in equation (2) to convert the nonlinear equation into four linear inequalities for both inclination and azimuth dynamics:

$$u(k) = z(k) \cdot \delta(k) \rightarrow \begin{array}{lll} u(k) & \leq & M_u \delta(k) \\ u(k) & \geq & m_u \delta(k) \\ u(k) & \leq & z(k) - m_u(1 - \delta(k)) \\ u(k) & \geq & z(k) - M_u(1 - \delta(k)) \end{array}, \tag{2}$$

in which $M_u$ and $m_u$ are the maximum and minimum bounds u. This transformation allows both u(k) and z(k) to be equivalent under different δ(k). For example, when δ(k)=1 (slide mode), the first two inequalities of equation (2) provide an upper and lower bound constraints on u(k) while the latter two forces u(k)=z(k) through u(k)≤z(k) and u(k) ≥z(k). Similarly, when δ(k)=0, the first two inequalities impose u(k)=0 by having u(k)≤0 and u(k)≥0 while latter two ensures that z(k) becomes zero when u(k)=0.

In an embodiment, for each slide mode within the slide-rotate command sequence, the toolface angles may remain constant. This constraint is included as two linear inequalities shown in equation (3) and is imposed on both inclination and azimuth dynamics:

$$\begin{array}{l} u(k) - u(k-1) \leq (M_u - m_u) \cdot (2 - \delta(k-1) - \delta(k)) \\ u(k) - u(k-1) \geq (m_u - M_u) \cdot (2 - \delta(k-1) - \delta(k)) \end{array}. \tag{3}$$

Equation (3) causes the predictive control module 209 to force change between two consecutives u(k), i.e., u(k) and u(k−1), to be zero under slide mode. For example, when δ(k) and δ(k−1) are ones, the right-hand side of equation (3) becomes zero causing the difference between u(k) and u(k−1) to become zero. Under rotate mode, u(k)−u(k−1)=0 due to equation (2), so equation (3) still holds since both inequalities remain satisfied. During transition mode (i.e., from slide to rotate modes or vice-versa), equation (3) remains valid since u(k)−u(k−1) is bounded by the difference between its upper and lower bounds.

Depending on the conditions in the wellbore and drill tool capabilities, the predictive control module 209 may specify the minimum slide and rotate lengths as a set of inequalities shown in equations (4) and (5), respectively:

$$(\mathcal{S}^{min} - 1) \cdot [\delta(k) - \delta(k-1)] \leq \sum_{i=1}^{\mathcal{S}^{min}-1} \delta(k+1), \tag{4}$$

$$(\mathcal{R}^{\min} - 1) \cdot [\delta(k-1) - \delta(k)] \leq (\mathcal{R}^{\min} - 1) - \sum_{i=1}^{\mathcal{R}^{\min}-1} \delta(k+1), \tag{5}$$

in which $$\frac{\text{minimum slide length}}{\Delta k}$$

is defined as $\mathcal{S}^{\min}$ and $\mathcal{R}^{\min}$ is defined as $$\frac{\text{minimum rotate length}}{\Delta k},$$

where ΔK is the discretized depth length. During a transition from rotate to slide mode at the kth index, i.e., δ(k−1)=0 and δ(k)=1, the minimum slide length is imposed in the optimization by forcing the next δ(k+1) to δ(k+$\mathcal{S}^{\min}$−1) duty cycle to become one to satisfy the inequality in equation (4). Similarly, for a transition from slide to rotate at the kth index, the next δ(k+1) to δ(k+$\mathcal{R}^{\min}$−1) duty cycle are forced to be zero to ensure that equation (5) remains valid.

In an embodiment, the predictive control module 209 applies two "tie-to-stand" constraints. One is starting-a-stand with a slide or rotate mode, and the other is ending-a-stand with a rotate mode. The former can be represented by forcing δ(k)=0 or δ(k)=1 for $\mathcal{S}^{\min}$ or $\mathcal{R}^{\min}$ of k indices at the start of each ith stand while the latter forces δ(k)=0 for $\mathcal{R}^{\min}$ of k indices at the end of each ith stand within the horizon.

To ensure that build and turn rates adhere to corresponding upper and lower bound values during slide and rotate modes, the predictive control module may carry out the determination of equation (6) below:

$$m_\kappa \cdot \delta(k) + K_{rotate} \cdot (1 - \delta(k)) \le \kappa(k) \le M_\kappa \cdot \delta(k) + K_{rotate} \cdot (1 - \delta(k)) \quad (6)$$

in which $M_\kappa$ and $m_\kappa$ represent the upper and lower of κ (which can refer to both build and turn rate).

Further, in an embodiment, the predictive control module 209 may apply a quadratic constraint on the steering input to ensure that the unforced inclination and azimuth dynamics given in equation (1) are coupled. Additionally, the constraint helps to ensure that the magnitude of control is bounded by δ(k). In an embodiment, the constraint is given as:

$$u_{inc}^2(k) + u_{azi}^2(k) = \delta^2(k) \quad (7)$$

in which $u_{inc}$, $u_{azi}$ refer to the steering inputs for the inclination and azimuth planes, respectively. On some occasions where a limit on the three-dimensional curvature of the wellbore is desired, the predictive control module 209 may apply the following quadratic inequality:

$$\kappa_{inc}^2(k) + \sin^2(inc(k)) \cdot \kappa_{azi}^2(k) \le \nu^2 \quad (8)$$

in which $\kappa_{inc}$, $\kappa_{azi}$ refer to build rate and walk rate, respectively.

The control objective function which decides the type of control schemes to be undertaken during drilling can be established with equation (9):

$$\mathcal{J}(k) = \underbrace{w_p \mathcal{J}_p(\theta, \phi)}_{\text{Position Ctl}} + \overbrace{w_a \mathcal{J}_a(\theta, \phi)}^{\text{Attitude Ctl}} + \underbrace{w_p \mathcal{J}_c(\kappa)}_{\text{Curvature Ctl}} + \overbrace{w_d \|\delta\|_2^2}^{\text{Slide Ctl}} \quad (9)$$

in which $\mathcal{J}_p$, $\mathcal{J}_a$, $\mathcal{J}_c$ are the sum-of-squares error between the measured and reference components of inclination, azimuth, build rates and turn rates, $w_p$, $w_a$, $w_c$>0 are weighting factors to determine the control schemes used, e.g., when $w_p$=1 and $w_a$=$w_c$=0 refers to a position control scheme while having $w_a$>$w_p$>$w_c$>0 refers to a hybrid control mode where attitude control is being prioritized over position and curvature control, and $w_d$>0 is used to penalize the amount slides in the horizon. The latter weighting factor helps to ensure that the slide mode in the horizon is used only as required by the well plan.

Figure 5:
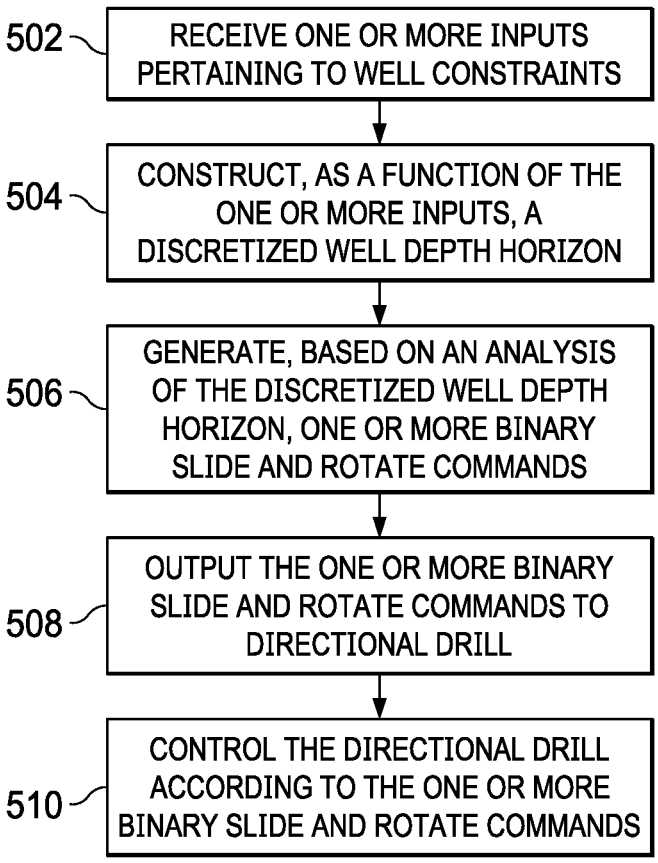
FIG. 5 illustrates a method for controlling a trajectory of a mud motor directional drill, according to an embodiment.

Referring now to FIG. 5, the device 200 (or controller 152), in operation, may perform a method 500 for controlling a trajectory of a mud motor directional drill, e.g., after inserting a new pipe and in building a curve in the wellbore according to a reference well plan. As shown, the method 500 begins in block 502, in which the device 200 receives one or more inputs pertaining to wellbore constraints. For example, the constraints may include the initial conditions 302, control objectives 304, system constraints 306, and reference well plan 308 discussed above. The device 200 may further receive updated conditions of the drilling system (e.g., derived from a separate calibration module using latest measurement feedback). In block 504, the device 200 constructs, as a function of the one or more inputs, a discretized well depth horizon. The device 200 may use the discretized well depth horizon to obtain a lookahead horizon and formulate a mixed integer control problem according to the system dynamics and constraints discussed relative to equations (1)-(8) for both the inclination and azimuth planes.

In block 506, the device 200 generates, based on an analysis of the discretized well depth horizon, one or more binary slide and rotate commands and toolface commands. More particularly, the predictive control module 209 may solve for the equations (1)-(8) using the inputs as values for the equation variables. For example, to do so, the device 200 may use a MINLP (mixed-integer nonlinear programming)/MIQCQP (mixed-integer quadratically-constrained quadratic program) solver.

In block 508, the device 200 outputs the one or more binary slide and rotate commands to the drill based on the analysis. More particularly, the output of the precision control module 209 may result in a sequence of binary values, such that, for example, a value of 1 in the sequence corresponds to a slide mode command and a value of 0 corresponds to a rotate mode command. Further, the device 200 may also output corresponding toolface commands for controlling the drill to achieve certain well plan requirements, such as attitude and position. In block 510, the device 200 causes the drill to execute the one or more binary slide and rotate and toolface commands. For example, to do so, the device 200 may transmit control signals or instructions to the bottom hole assembly 150 to steer the drill bit or string according to the command sequence. In some embodiments, the device 200 may repeat steps of the method 500 incrementally, such that the predictive control module 209 can obtain updated information about wellbore conditions and constraints and update optimization as necessary.

In an embodiment, instead of automatically controlling the drill, the device 200 may output a recommendation to a console (e.g., coupled with the device 200) that an operator may review, in which the recommendation includes the one or more binary slide and rotate commands. After review, the operator may manually set the slide and rotate commands to control the directional drill according to the recommendation. The operator may also manually control the device 200 to repeat steps of the method 500 incrementally, such that the predictive control module 209 can obtain updated information about wellbore conditions and constraints and update optimization as necessary.

Figure 6A:
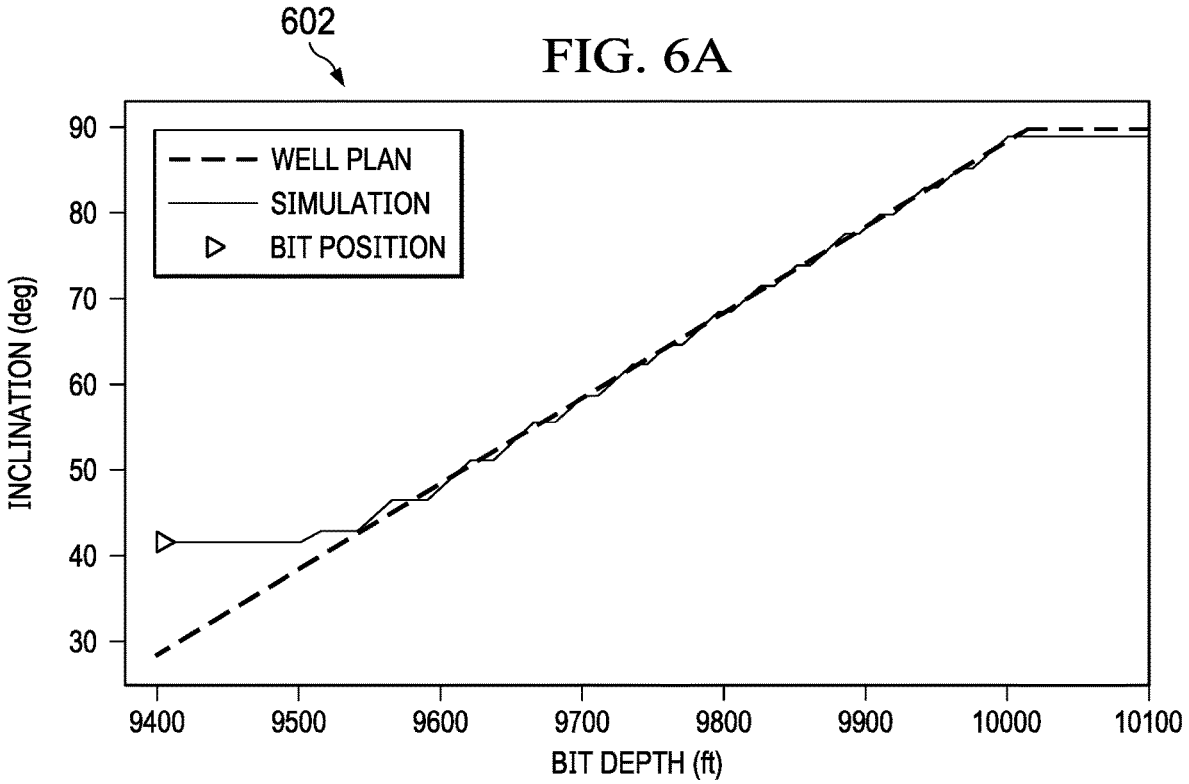
FIGS. 6A-6C illustrate various graphs of results of an example drilling operation using the techniques of the present disclosure, according to an embodiment.
Figure 6B:
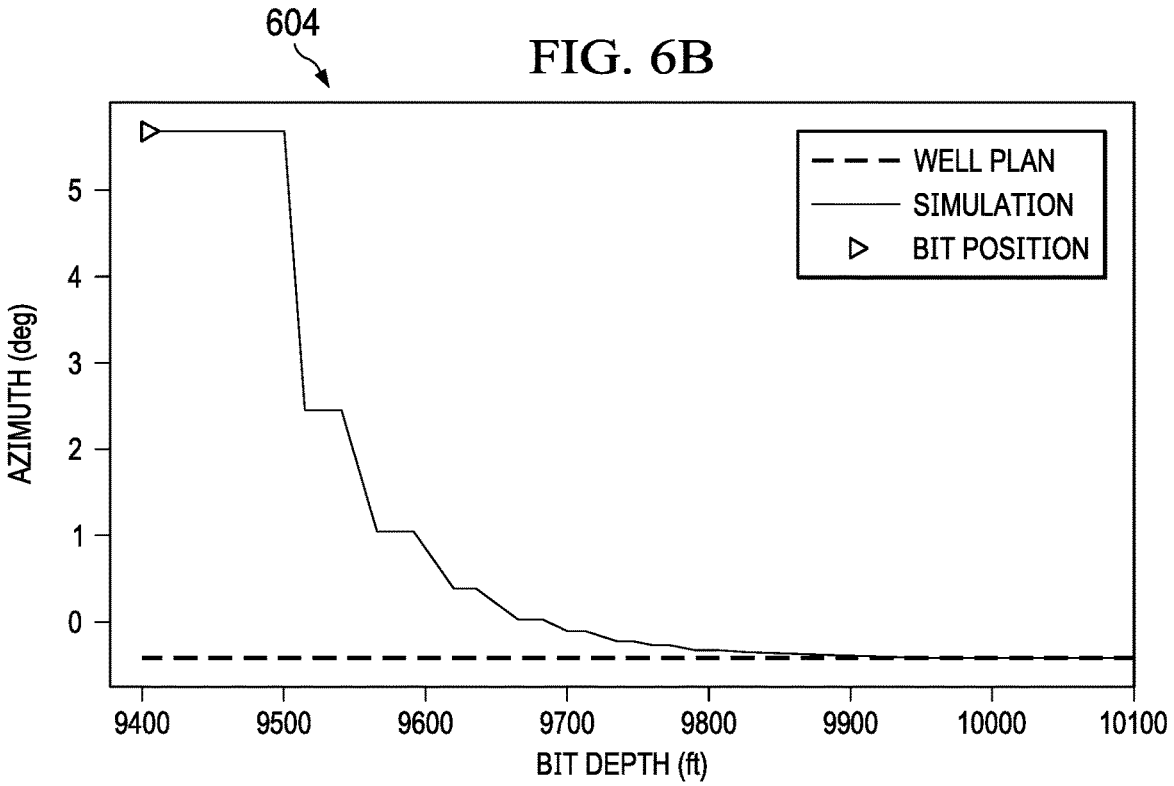
Figure 6C:
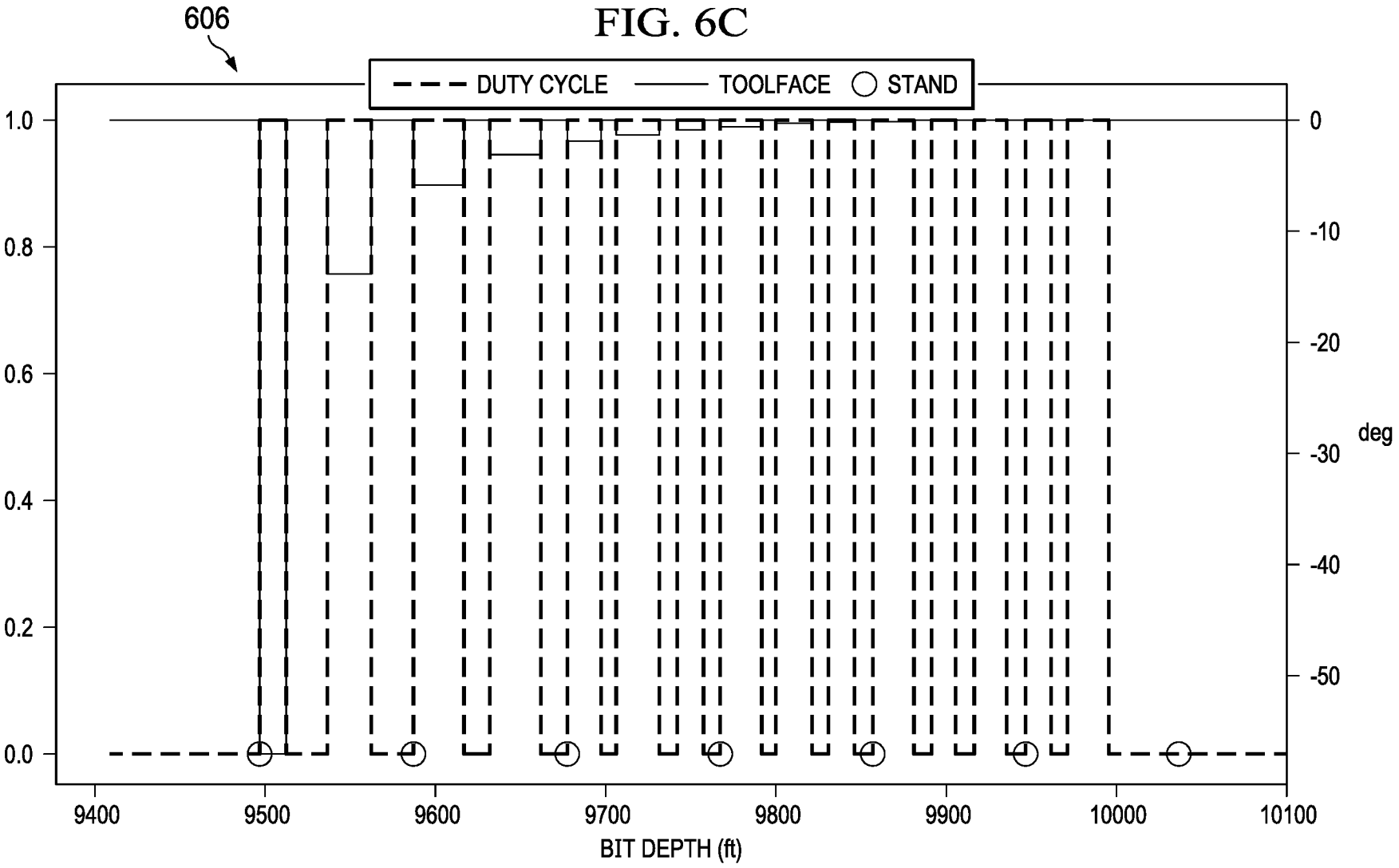

Referring now to FIGS. 6A-6C, an example output from the techniques of the present disclosure are shown. In this simulated example, assume that the device 200 has applied the following constraints: a minimum slide length of fifteen feet, a minimum rotate length of ten feet, a tie-to-stand constraint of "start stand with a slide command," and the control scheme used is attitude control.

Referring now to FIG. 6A, graph 602 illustrates a plot of bit depth (measured in fect) and inclination (measured in degrees), in which well plan data and simulation data are compared against one another. Graph 604 of FIG. B illustrates a plot of bit depth (measured in fect) relative to azimuth (measured in degrees), in which well plan data and simulation data are compared against one another. As demonstrated in graphs 602 and 604, the predictive control module 209 is able to track a reference well plan in terms of inclination and azimuth as the drill bit moves along a trajectory within the borehole.

Graph 606 of FIG. C illustrates a graph of duty cycle and toolface as a function of bit depth and may represent output of the predictive control module 209 in the simulation. The right hand axis represents toolface (measured in degrees), which are the toolface values to be used to achieve an inclination that achieves the reference well plan. The duty cycle is indicative of the slide and rotate sequence generated by the predictive control module 209. The circle mark in the graph represents a stand position relative to the bit depth, in which the drill is in a slide mode operation when the circle mark is at 1.0 and in a rotate mode operation when the circle mark falls to 0.0. Based on the reference well plan, graph 606 indicates that the operation begins the stand with a slide mode operation and ends the stand with a rotate mode operation, thus satisfying the aforementioned constraints.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure.

Clause 1 includes a system comprising one or more processors; a memory storing a plurality of instructions, which, when executed on a processor, causes the system to receive one or more inputs pertaining to constraints for a wellbore and tool capability in a mud motor drilling operation, construct, as a function of the one or more inputs, a discretized well depth horizon, generate, based on an analysis of the discretized well depth horizon, one or more binary slide and rotate commands for controlling a directional drill within the wellbore, and control the directional drill according to the one or more binary slide and rotate commands.

Clause 2 includes the subject matter of Clause 1, and wherein the plurality of instructions causes the system to further generate one or more toolface commands for controlling the directional drill, and wherein the directional drill is further controlled according to the one or more toolface commands.

Clause 3 includes the subject matter of any of Clauses 1 and 2, and wherein the plurality of instructions causes the system to further update the one or more inputs after controlling the directional drill according to the one or more binary and slide rotate commands.

Clause 4 includes the subject matter of any of Clauses 1-3, and wherein the one or more inputs comprises system constraints, initial conditions of the directional drill, control objectives, and a well plan for the mud motor drilling operation.

Clause 5 includes the subject matter of any of Clauses 1-4, and wherein the plurality of instructions further causes the system to track, using the discretized well depth horizon, a position of a drill bit of the directional drill along a trajectory of the well plan over an incremental distance based on the received one or more inputs.

Clause 6 includes the subject matter of any of Clauses 1-5, and wherein the plurality of instructions further causes the system to identify one or more stand locations in the discretized well depth horizon.

Clause 7 includes the subject matter of any of Clauses 1-6, and wherein to control the directional drill according to the one or more binary slide and rotate commands comprises to transmit control signals to steer a drill bit of the directional drill according to the one or more binary slide and rotate commands.

Clause 8 includes a method comprising receiving one or more inputs pertaining to constraints for a wellbore and tool capability in a mud motor drilling operation, constructing, as a function of the one or more inputs, a discretized well depth horizon, generating, based on an analysis of the discretized well depth horizon, one or more binary slide and rotate commands for controlling a directional drill within the wellbore, and controlling the directional drill according to the one or more binary slide and rotate commands.

Clause 9 includes the subject matter of Clause 8, and further including generating one or more toolface commands for controlling the directional drill, and wherein the directional drill is further controlled according to the one or more toolface commands.

Clause 10 includes the subject matter of any of Clauses 8 and 9, and further including updating the one or more inputs after controlling the directional drill according to the one or more binary and slide rotate commands.

Clause 11 includes the subject matter of any of Clauses 8-10, and wherein the one or more inputs comprises system constraints, initial conditions of the directional drill, control objectives, and a well plan for the mud motor drilling operation.

Clause 12 includes the subject matter of any of Clauses 8-11, and further including tracking, using the discretized well depth horizon, a position of a drill bit of the directional drill along a trajectory of the well plan over an incremental distance based on the received one or more inputs.

Clause 13 includes the subject matter of any of Clauses 8-12, and further including identifying one or more stand locations in the discretized well depth horizon.

Clause 14 includes the subject matter of any of Clauses 8-13, and wherein controlling the directional drill according to the one or more binary slide and rotate commands comprises transmitting control signals to steer a drill bit of the directional drill bit according to the one or more binary slide and rotate commands.

Clause 15 includes a computer-readable storage medium storing a plurality of instructions, which, when executed, causes a system to receive one or more inputs pertaining to constraints for a wellbore and tool capability in a mud motor drilling operation, construct, as a function of the one or more inputs, a discretized well depth horizon, generate, based on an analysis of the discretized well depth horizon, one or more binary slide and rotate commands for controlling a directional drill within the wellbore, and control the directional drill according to the one or more binary slide and rotate commands.

Clause 16 includes the subject matter of Clause 15, and wherein the plurality of instructions causes the system to further generate one or more toolface commands for controlling the directional drill, and wherein the directional drill is further controlled according to the one or more toolface commands.

Clause 17 includes the subject matter of any of Clauses 15 and 16, and wherein the plurality of instructions causes the system to further update the one or more constraints after controlling the directional drill according to the one or more binary and slide rotate commands.

Clause 18 includes the subject matter of any of Clauses 15-17, and wherein the one or more inputs comprises system constraints, initial conditions of the directional drill, control objectives, and a well plan for the mud motor drilling operation, and wherein the plurality of instructions further causes the system to track, using the discretized well depth horizon, a position of a drill bit of the directional drill along a trajectory of the well plan over an incremental distance based on the received one or more inputs.

Clause 19 includes the subject matter of any of Clauses 15-18, and wherein the plurality of instructions further causes the system to identify one or more stand locations in the discretized well depth horizon.

Clause 20 includes the subject matter of any of Clauses 15-19, and wherein to control the directional drill according to the one or more binary slide and rotate commands comprises to transmit control signals to steer a drill bit of the directional drill bit according to the one or more binary slide and rotate commands.

Embodiments of the present disclosure may be implemented, in hardware, firmware, software, or any combination thereof. The embodiments of the present disclosure may also be implemented as instructions carried by or stored on a transitory or non-transitory machine-readable (e.g., computer-readable) storage medium, which may be read and executed by one or more processors. A machine-readable storage medium may be embodied as any storage device, mechanism, or other physical structure for storing or transmitting information in a form readable by a machine (e.g., a volatile or non-volatile memory, a media disc, or other media device).

As used herein, the singular forms "a," "an," and "the" are intended to include the plural forms as well, unless the context clearly indicates otherwise. It will be further understood that the terms "comprise" and/or "comprising," when used in this specification and/or in the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A method comprising:

receiving one or more inputs pertaining to constraints for a wellbore and tool capability in a mud motor drilling operation, constructing, as a function of the one or more inputs, a discretized well depth horizon, generating, based on an analysis of the discretized well depth horizon, one or more binary slide and rotate commands for controlling a directional drill within the wellbore, and controlling the directional drill according to the one or more binary slide and rotate commands.

2. The method of claim 1, further comprising generating one or more toolface commands for controlling the directional drill, and wherein the directional drill is further controlled according to the one or more toolface commands.

3. The method of claim 1, further comprising updating the one or more inputs after controlling the directional drill according to the one or more binary and slide rotate commands.

4. The method of claim 1, wherein the one or more inputs comprises system constraints, initial conditions of the directional drill, control objectives, and a well plan for the mud motor drilling operation.

5. The method of claim 4, further comprising tracking, using the discretized well depth horizon, a position of a drill bit of the directional drill along a trajectory of the well plan over an incremental distance based on the received one or more inputs.

6. The system of claim 5, further comprising identifying one or more stand locations in the discretized well depth horizon.

7. The system of claim 1, wherein controlling the directional drill according to the one or more binary slide and rotate commands comprises transmitting control signals to steer a drill bit of the directional drill bit according to the one or more binary slide and rotate commands.

* * * * *